US007638936B2

(12) United States Patent
Kuo

(10) Patent No.: US 7,638,936 B2
(45) Date of Patent: Dec. 29, 2009

(54) PLANE EMISSIVE CATHODE STRUCTURE OF FIELD EMISSION DISPLAY

(75) Inventor: Chih-Che Kuo, Taipei (TW)

(73) Assignee: Teco Electric & Machinery Co., Ltd., Taipei (TW)

( * ) Notice: Subject to any disclaimer, the term of this patent is extended or adjusted under 35 U.S.C. 154(b) by 402 days.

(21) Appl. No.: 11/757,560

(22) Filed: Jun. 4, 2007

(65) Prior Publication Data

US 2008/0297025 A1 Dec. 4, 2008

(51) Int. Cl.
*H01J 1/62* (2006.01)

(52) U.S. Cl. ..... 313/497; 313/309

(58) Field of Classification Search ..... None
See application file for complete search history.

(56) References Cited

U.S. PATENT DOCUMENTS 4,728,851 A * 3/1988 Lambe ..... 313/309
5,173,635 A * 12/1992 Kane ..... 313/309
5,214,346 A * 5/1993 Komatsu ..... 313/309
5,300,853 A * 4/1994 Watanabe et al. ..... 313/309
6,891,320 B2 5/2005 Nakamoto
2005/0156506 A1 * 7/2005 Chung et al. ..... 313/495
2006/0208654 A1 * 9/2006 Kawate et al. ..... 315/169.2
2008/0191189 A1 * 8/2008 Kastalsky ..... 257/10

* cited by examiner

*Primary Examiner*—Ashok Patel
(74) *Attorney, Agent, or Firm*—Chung-Ming Shih

(57) ABSTRACT

In a plane emissive cathode structure of a field emission display having a common plane structure, a cathode plate includes a cathode substrate, and a plurality of cathode units on the cathode substrate, and the cathode unit includes an emitter layer, a gate electrode layer and a dielectric layer. The emitter layer and the gate electrode layer are disposed on a common plane of the cathode substrate and separated with each other to form an interval. The dielectric layer is formed in the interval between the emitter layer and the gate electrode layer, but not connected to the interval between the emitter layer and the gate electrode layer, so as to change the electric field distribution of the emitter layer and the gate electrode layer.

9 Claims, 3 Drawing Sheets

PLANE EMISSIVE CATHODE STRUCTURE OF FIELD EMISSION DISPLAY

BACKGROUND OF THE INVENTION

1. Field of the Invention

The present invention relates to a field emitter, and more particularly to a cathode plate structure formed on a common plane.

2. Description of Prior Art

In recent years, flat panel display comes with the thin and light features, and its resolution and brightness are even better than those of traditional televisions, and thus flat panel displays are used extensively in the applications of different display sizes including the flat display panels as small as those for mobile phones or as large as those for outdoor billboards, and the applications of flat panel displays become increasingly popular in the market.

Various different types of flat panel displays are introduced constantly to the market, and liquid crystal display (LCD), plasma display panel (PDP), organic light emitting diode display (OLED) and field emission display (FED), particularly the field emission display (FED) become the mainstreams of flat panel displays. The principle of the field emission display (FED) primarily bombards an electron beam produced by an electron emission source of a cathode onto a fluorescent layer to produce light.

In general, a conventional field emission display of a triode structure includes an anode plate, a cathode plate, and a gate electrode layer between the anode and cathode plates, wherein the gate electrode layer provides an electric potential to attract electrons produced by the cathode plate, and the anode conductive layer provides a high potential to accelerate the kinetic energy of electrons and bombard electrons onto the anode plate to produce light.

Although the conventional structure provides a normal light emission for the field emission display, the gate electrode layer is designed and disposed directly between the cathode plate and the anode plate and proximate to the emitter of the cathode plate, and thus causing a more complicated manufacturing procedure of the cathode plate and incurring a higher manufacturing cost. To lower the cost and overcome the shortcomings of the aforementioned structure, another conventional cathode structure disposed on a common plane of the emitter and the gate electrode as disclosed in U.S. Pat. No. 6,891,320 was developed, and such patent made changes to the cathode structure that adopts a stacking method, and thus not only simplifying the manufacturing procedure, but also lowering the manufacturing cost.

The aforementioned design of forming the emitter and the gate electrode on a common plane structure of the cathode substrate has the advantages of lowering the cost and simplifying the manufacturing procedure, but it also affects the electric field of the electrons horizontally attracted from the emitter to the gate electrode. Since the vector of the electric field at the gate electrode surface affects the quantity and direction of the field emission electrons. With the same condition of electric potential, the larger the interval between the emitter and the gate electrode, the smaller is the intensity of the surface field of the emitter, and thus the efficiency of producing electrons by the emitter is reduced and the light emitting effect of the field emitter is affected directly.

Although the interval between the emitter and the gate electrode can be reduced to less than several microns (μm) by semiconductor fabrication processes, yet a high cost is incurred. Under the same condition of electric potential, the interval between the emitter and the gate electrode is too small, and the two electric fields interfere with each other, so that a portion of the free electrons discharged from the emitter are attracted by the gate electrode and cannot be accelerated to the anode, but the free electrons are moved towards the gate electrode instead, and thus causing an electric leak. If a thick film process is adopted, the manufacturing cost can be lowered, but the interval between the emitter and the gate electrode must be maintained above tens of microns (μm) due to the accuracy of the printed circuit board, or else a deformation caused by the planarity of the emitter and the gate electrode or the sintered material will result, and the emitter and the gate electrode will not function. To compensate the excessively large interval formed between the emitter and the gate electrode by the foregoing process, it is necessary to increase the electric potential of the anode plate to obtain a larger electric field of the anode plate with respect to the cathode plate, and thus regardless of which manufacturing process is adopted, there is a drawback of using the common plane structure of the cathode plate. The prior art definitely requires further improvements and feasible solutions.

SUMMARY OF THE INVENTION

In view of the foregoing shortcomings of the prior art, the inventor of the present invention based on years of experience in the related industry to conduct experiments and modifications, and finally developed a plane emissive cathode structure of a field emission display in accordance with the present invention to overcome the shortcomings of the prior art.

Therefore, it is a primary objective of the present invention to provide a plane emissive cathode structure of a field emission display that changes the electric field distribution by a dielectric layer, and the dielectric layer is disposed in an interval formed by corresponding separated emitter layer and gate electrode layer on a common plane for changing the electric field distributions of the emitter layer and the gate electrode layer. Since the common plane structure can be formed directly on a cathode substrate, the manufacturing cost can be lowered.

To achieve the foregoing objective, the present invention provides a plane emissive cathode structure of a field emission display, and the cathode plate includes a cathode substrate and a plurality of cathode units disposed on the cathode substrate.

The cathode unit includes an emitter layer, a gate electrode layer and a dielectric layer, wherein the emitter layer and the gate electrode layer are formed on a common plane of the cathode substrate and separated with an interval apart from each other, and the dielectric layer is disposed in an interval formed by the emitter layer and the gate electrode layer, but the dielectric layer is not connected to the interval formed by the emitter layer and the gate electrode layer to form a common plane structure of the cathode plate

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The technical characteristics, features and advantages of the present invention will become apparent in the following detailed description of the preferred embodiments with reference to the accompanying drawings. The drawings are provided for reference and illustration only, but not intended for limiting the present invention.

Figure 1:
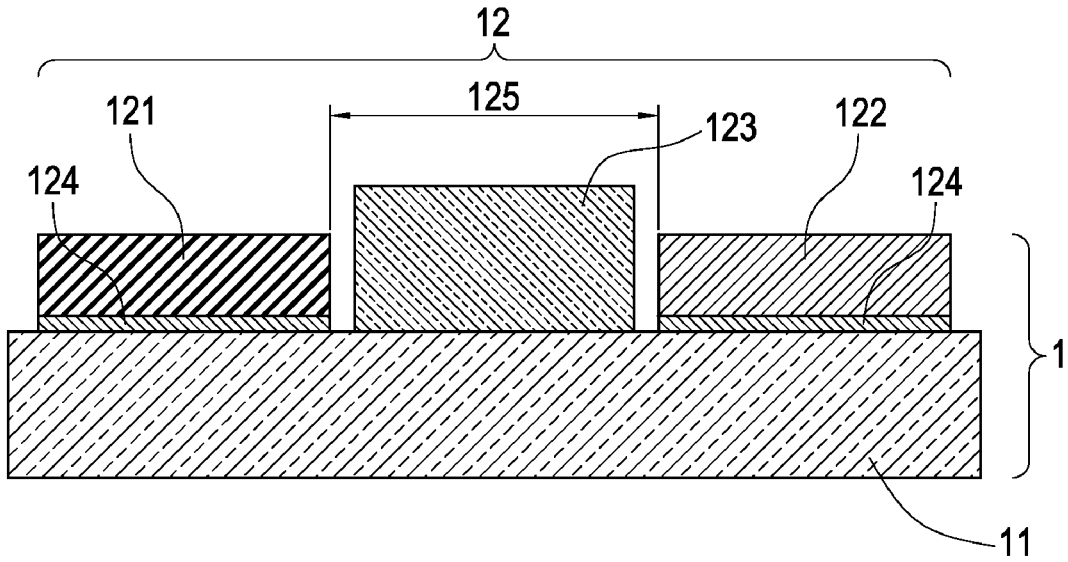
FIG. 1 is a section view of a structure of the invention.

Referring to FIG. 1 for a section view of a structure of the invention, the cathode plate 1 includes a cathode substrate 11 and a plurality of cathode units 12 disposed on the cathode substrate 11 and corresponding to an anode, and each cathode unit 12 includes an emitter layer 121, a gate electrode layer 122, a dielectric layer 123 and a cathode conductive layer 124, wherein the emitter layer 121 and the gate electrode layer 122 are formed on a common plane on the cathode substrate 11 and separately and electrically connected to the cathode conductive layer 124 to serve as an electric conductive path. The emitter layer 121 and the gate electrode layer 122 are separated with an interval 125 on the cathode substrate 11. In this preferred embodiment, the interval 125 between the emitter layer 121 and the gate electrode layer 122 is maintained to be 50 μm, and the thickness of the emitter layer 121 and the gate electrode layer 122 on the cathode substrate 11 falls within a range from 1 μm to 25 μm.

Figure 2:
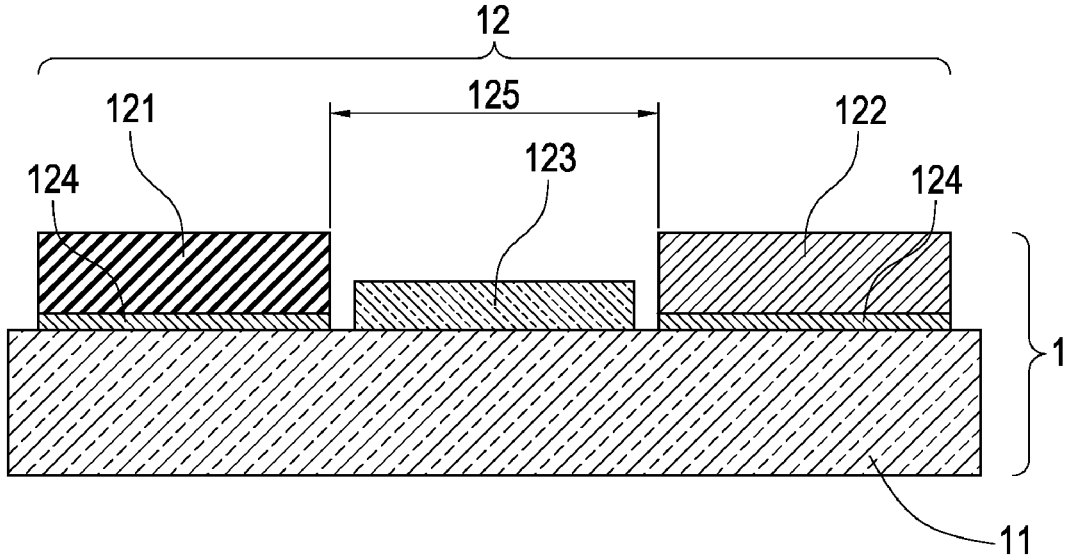
FIG. 2 is a section view of a structure of another embodiment of the invention.

The dielectric layer 123 is formed in the interval 125 between the emitter layer 121 and the gate electrode layer 12, and the emitter layer 121 and the gate electrode layer 122 are disposed on a common plane of the cathode substrate 11. In the meantime, the dielectric layer 123 and its adjacent emitter layer 121 and gate electrode layer 122 maintains a predetermined interval from each other, and the dielectric layer 123 is not connected to the emitter layer 121 or the gate electrode layer 122, wherein the interval is maintained within a range from 5 μm to 15 μm, and the dielectric layer 123 of this preferred embodiment is made of a material containing glass such as a glass paste, and the material is an insulator having a dielectric constant equal to or greater than 7, and the thickness of the dielectric layer 123 is 0.5 time to 1.5 times of the thickness of the emitter layer 121. In this preferred embodiment as shown in the figure, the thickness of the dielectric layer 123 is greater than the thickness of the emitter layer 121 and the gate electrode layer 122, or the thickness of the dielectric layer 123 is smaller than the thickness of the emitter layer 121 and the gate electrode layer 122 as shown in FIG. 2.

Figure 3:
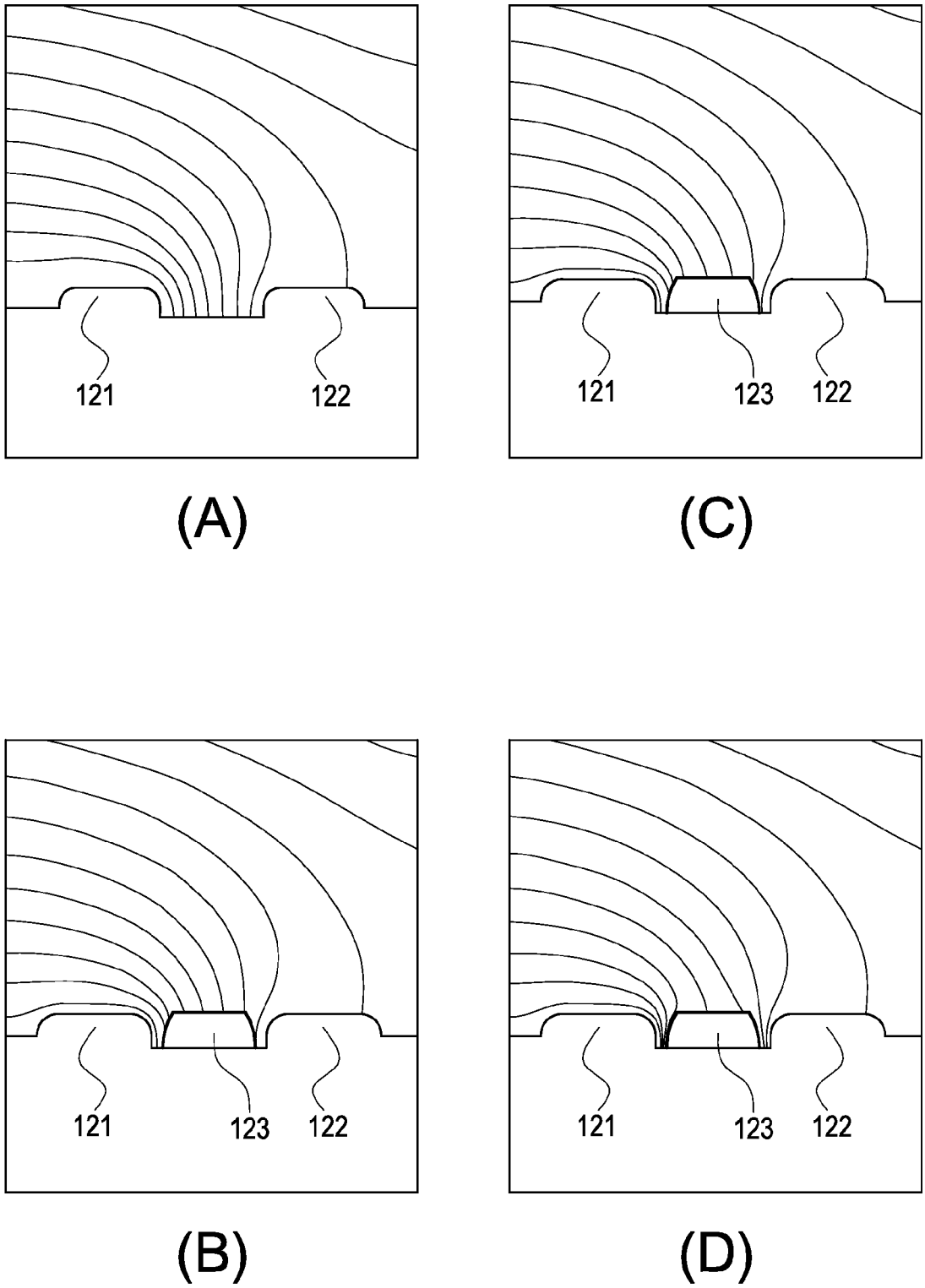
FIGS. 3A to 3D are schematic views of electric field distributions of the invention.

Referring to FIGS. 3A and 3B for the comparison of electric field distributions of the present invention, the electric field distributions of the situation with and without a dielectric layer 123 are compared. In FIG. 3A, the electric field is centralized at the interval 125 between the emitter layer 121 and the gate electrode layer 122, so that the electrons produced by the emitter layer 121 cannot be emitted to the corresponding anode completely, and an electric leak will result. In FIG. 3B, the dielectric layer 123 is disposed in the interval 125 between the emitter layer 121 and the gate electrode layer 122, and the density of the interval 125 becomes lower, so that after the electrons of the emitter layer 121 are attracted outward, the electrons are attracted by the electric potential of the anode and bombarded to the anode. The dielectric layer 123 formed on a common plane structure between the emitter layer 121 and the gate electrode layer 122 not only simplifies the manufacturing procedure of the cathode plate 1, but also uses the dielectric layer 123 as an isolation between the emitter layer 121 and the gate electrode layer 122 for changing the electric field distribution density between the emitter layer 121 and the gate electrode layer 122, preventing the electrons of the emitter layer 121 from moving to the gate electrode layer 122, and reducing the electric leak of the cathode plate 1. Referring to FIGS. 3C and 3D, dielectric layers 123 having different dielectric constants are adopted, and the dielectric constant of the dielectric layer 123 of a preferred embodiment as shown in FIG. 3D is greater than the dielectric constant of the dielectric layer 123 as shown in FIG. 3C. The electric field distribution density at a position proximate to the emitter 121 as shown in FIG. 3D is greater than the electric field distribution density proximate to the emitter 121 as shown in FIG. 3C.

Figure 4:
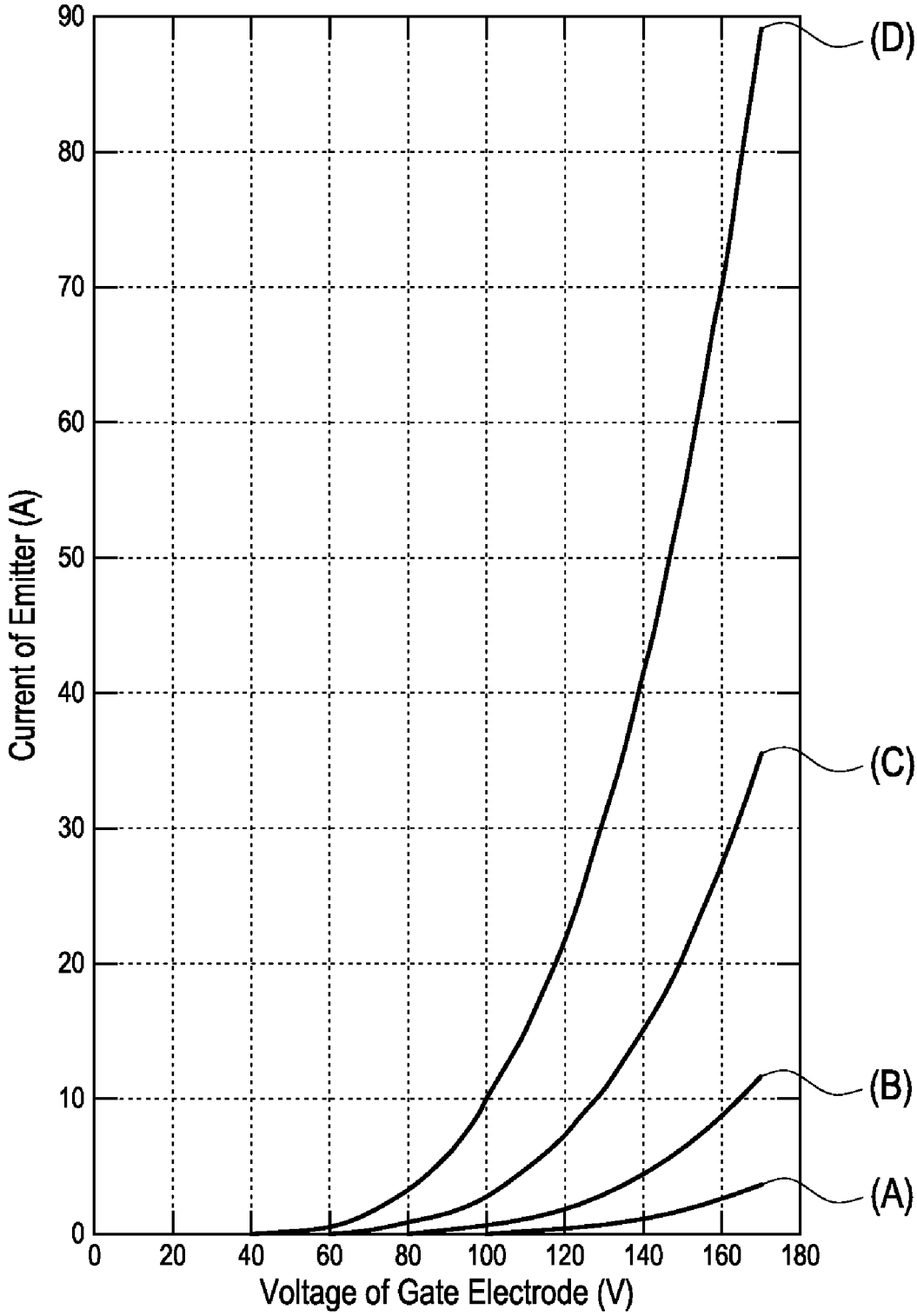
FIG. 4 is a graph of the current discharged from an emitter versus the voltage of a gate electrode of the invention.

Referring to FIGS. 3B to 3C and 4, the electric field distribution densities of the emitter layer 121 and the gate electrode layer 122 are changed under the effect of the dielectric layers 123 having different dielectric constants as shown in FIG. 4. The greater the dielectric constant of the dielectric layer 123, the greater is the current discharged by the emitter layer 121, provided that equal voltage is applied to the gate electrode layer 122.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A plane emissive cathode structure of field emission display, comprising:

a cathode substrate;

a plurality of cathode units, disposed on the cathode substrate and each cathode unit further comprising:

an emitter layer;

a gate electrode layer, disposed on a common plane of the emitter layer of the cathode substrate, and separated from the corresponding emitter layer to form a constant interval; and a dielectric layer, disposed in the interval between the emitter layer and the gate electrode layer, and on a common plane of the emitter layer and the gate electrode layer of the cathode substrate, and the dielectric layer separately forming an interval with the emitter layer and the gate electrode layer.

2. The plane emissive cathode structure of field emission display as recited in claim 1, wherein the interval is 50 μm.

3. The plane emissive cathode structure of field emission display as recited in claim 1, wherein a thickness of the emitter layer and the gate electrode layer is 5 μm~15 μm.

4. The plane emissive cathode structure of field emission display as recited in claim 1, wherein the dielectric layer is made of a material containing glass.

5. The plane emissive cathode structure of field emission display as recited in claim 1, wherein the dielectric layer is made of a glass paste.

6. The plane emissive cathode structure of field emission display as recited in claim 1, wherein the dielectric layer has a dielectric constant equal to or greater than 7.

7. The plane emissive cathode structure of field emission display as recited in claim 1, wherein the dielectric layer has a thickness equal to 0.5 time~1.5 times of the thickness of the emitter layer.

8. The plane emissive cathode structure of field emission display as recited in claim 1, wherein the dielectric layer has a thickness greater than the thickness of the emitter layer.

9. The plane emissive cathode structure of field emission display as recited in claim 1, wherein the dielectric layer has a thickness smaller than the thickness of the emitter layer.

* * * * *